US008594896B2

(12) United States Patent
Nicholson et al.

(10) Patent No.: US 8,594,896 B2
(45) Date of Patent: Nov. 26, 2013

(54) LIFT ARM CONTROL SYSTEM

(75) Inventors: Christian Nicholson, Cary, NC (US); Todd R. Farmer, Dana Point, CA (US)

(73) Assignee: Caterpillar SARL, Geneva (CH)

( * ) Notice: Subject to any disclaimer, the term of this patent is extended or adjusted under 35 U.S.C. 154(b) by 326 days.

(21) Appl. No.: 12/958,969

(22) Filed: Dec. 2, 2010

(65) Prior Publication Data

US 2011/0150614 A1 Jun. 23, 2011

Related U.S. Application Data

(63) Continuation-in-part of application No. 12/642,120, filed on Dec. 18, 2009.

(51) Int. Cl.
*A01B 67/00* (2006.01)
*G06F 19/00* (2006.01)

(52) U.S. Cl.
USPC ..... 701/50; 37/348

(58) Field of Classification Search
USPC ..... 701/50; 37/348; 414/685; 700/169
See application file for complete search history.

(56) References Cited

U.S. PATENT DOCUMENTS 4,266,909 A 5/1981 Langenfeld
4,375,344 A 3/1983 Baum et al.
4,844,685 A 7/1989 Sagaser
5,188,502 A 2/1993 Tonsor et al.
5,234,312 A 8/1993 Hirose
5,924,516 A 7/1999 Sagaser et al.
6,109,858 A * 8/2000 Deneve et al. ..... 414/685
6,140,787 A 10/2000 Lokhorst et al.
6,205,687 B1 * 3/2001 Rocke ..... 37/348
6,951,067 B1 10/2005 Dietz et al.
7,140,830 B2 11/2006 Berger et al.
7,530,185 B2 5/2009 Trifunovic
2001/0032031 A1 * 10/2001 Ufheil ..... 700/169
2004/0136821 A1 7/2004 Berger et al.
2005/0044753 A1 3/2005 Lohnes et al.
2006/0222176 A1 10/2006 Ohishi
2009/0082930 A1 * 3/2009 Peters ..... 701/50

OTHER PUBLICATIONS

KIPO, International Search Report in International Application No. PCT/US2011/062521, Feb. 28, 2012, 4 pp.
KIPO, Written Opinion in International Application No. PCT/US2011/062521, Feb. 28, 2012, 7 pp.

* cited by examiner

*Primary Examiner* — Tan Q Nguyen
(74) *Attorney, Agent, or Firm* — Leydig, Voit & Mayer

(57) ABSTRACT

A system for a loader controlling movement of a lift arm of the loader near a limit of travel of the lift arm receives a signal indicative of the loader engine speed and a signal indicative of actuation of a sensor on the lift arm. A controller determines a lift arm command signal based at least upon the engine speed signal, and transmits the lift arm command signal to an electro-hydraulic system to control the movement of the lift arm adjacent the limit of travel of the lift arm.

20 Claims, 5 Drawing Sheets

LIFT ARM CONTROL SYSTEM

CROSS-REFERENCE TO RELATED APPLICATION

This patent application is a continuation-in-part of copending U.S. patent application Ser. No. 12/642,120, filed Dec. 18, 2009.

TECHNICAL FIELD

This disclosure relates generally to a system for controlling a lift arm and, more particularly, to a system for automatically controlling movement of the lift arm near a limit of travel of the lift arm.

BACKGROUND

Machines with various implements are often used in the materials handling and construction industries. These machines typically include one or more lift arms for moving an implement from a starting position to a limit of travel position in order to perform a desired task. The machines are often used for motions of some type such as lifting a load of material and dumping it at another location. The machine may then be returned to the original location and the implement lowered to the starting position in order to begin another material movement cycle. Upon reaching the dumping location as well as the starting position, it is desirable for the operator to operate input devices to slow down the movement of the lift arms to minimize the likelihood that the lift arms will being moving rapidly and then abruptly stop upon reaching their limit of travel positions. Such a sudden stop may cause wear to the machine and spillage of material being carried by the implement.

U.S. Pat. No. 7,140,830 to Berger et al. discloses an electronic control system for skid steer loaders. More specifically, the Berger et al. system provides a complex variety of modes, features, and options for controlling implement position. However, the Berger et al. system relies largely upon multiple position sensors for information about and to control the implement position which adds cost and complexity to the system.

The foregoing background discussion is intended solely to aid the reader. It is not intended to limit the innovations described herein nor to limit or expand the prior art discussed. Thus the foregoing discussion should not be taken to indicate that any particular element of a prior system is unsuitable for use with the innovations described herein, nor is it intended to indicate any element, including solving the motivating problem, to be essential in implementing the innovations described herein. The implementations and application of the innovations described herein are defined by the appended claims.

SUMMARY

In one aspect, the described principles allow a system for a loader to control the movement of a lift arm proximate to its limit of travel. The system includes a controller operable to receive a signal indicative of the speed of an engine on the loader and to receive a signal indicative of actuation of an operator interface on the loader. The operator interface actuation signal indicates a desired movement of the lift arm. The controller receives a signal indicative of actuation of a sensor on the lift arm upon movement of the sensor past a sensor trigger on the loader at a position adjacent a limit of travel of the lift arm. Based at least upon the engine speed signal and the sensor actuation signal, the controller determines a lift arm command signal for directing movement of the lift arm. The controller then transmits the lift arm command signal to an electro-hydraulic system to control the movement of the lift arm adjacent the limit of travel of the lift arm.

DETAILED DESCRIPTION

Figure 1:
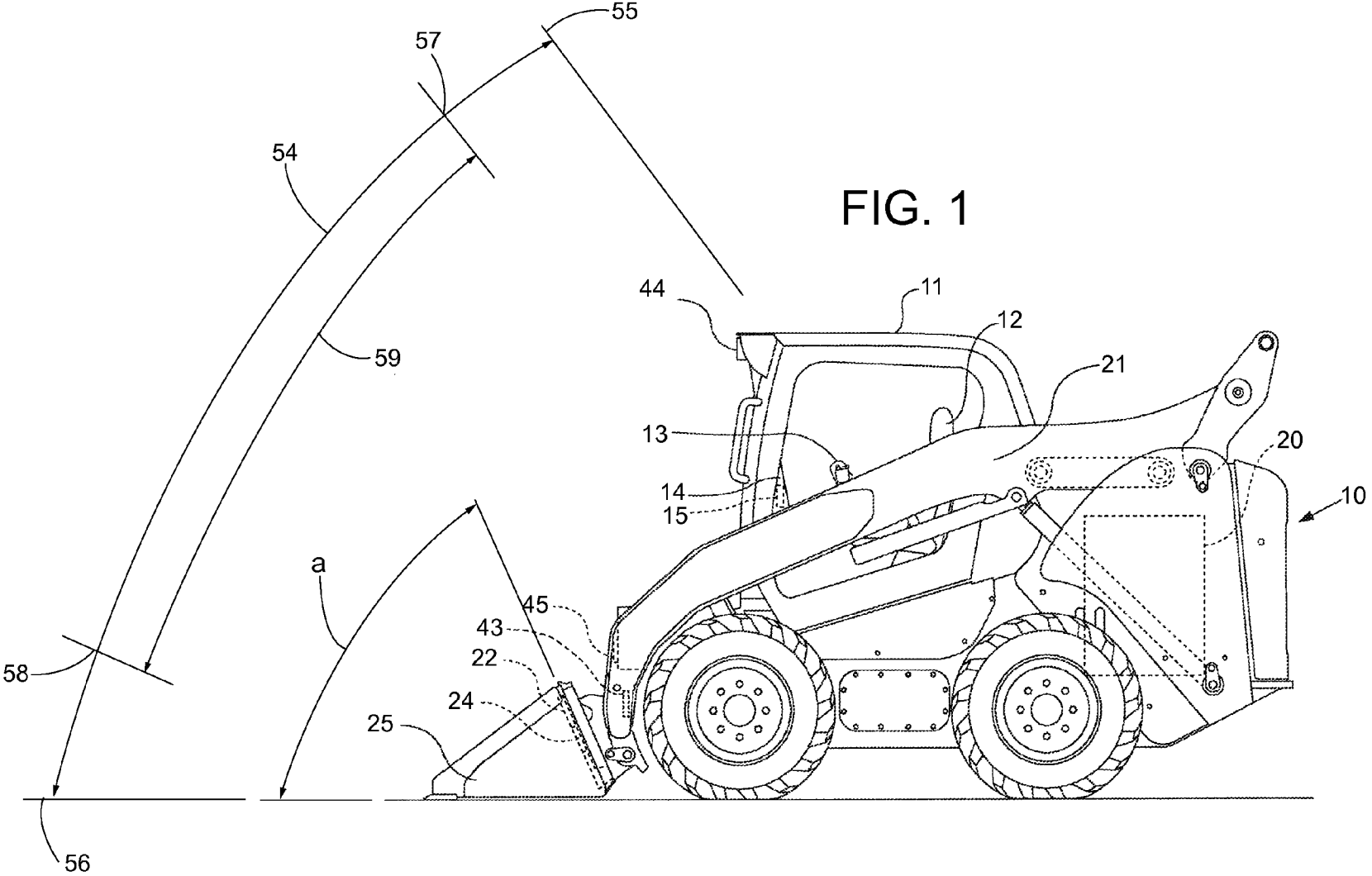
FIG. 1 is an elevational view of a loader in accordance with the disclosure.

FIG. 1 illustrates an exemplary machine or loader 10 having a cab 11 housing an operator seat 12, an operator interface 13, a control panel 14, and a controller 15. The loader 10 further includes an engine system 20, one or more lift arms 21, a lift arm actuation system 46 (FIG. 2), a coupler 22 mounted on the lift arm 21, a coupler actuation system 23 (FIG. 2), and an angle sensor 24 mounted on the coupler 22. An implement 25 is attached to the coupler 22. The operator interface 13, the control panel 14, the engine system 20, lift arm actuation system 46, the coupler actuation system 23, and the angle sensor 24 are each configured to communicate with the controller 15. The loader 10 is provided with sufficient electrical and electronic connectivity (not shown) to enable such communication. Though the illustrated loader 10 is a skid steer loader, the loader may be any other type of loader.

The controller 15 may be a single microprocessor or a plurality of microprocessors and could also include additional circuitry and components for random access memory, storage, and other functions as necessary to enable the functionalities described herein. The lift arm actuation system 46 is an electro-hydraulic actuation system linking the controller 15 and the lift arm 21 and controlling movement of lift arm 21. The coupler actuation system 23 is an electro-hydraulic actuation system linking the controller 15 and the coupler 22 and controlling movement of coupler 22 and thus also controlling movement of implement 25. As used herein, an electro-hydraulic actuation system may include a plurality of fluid and electrical components such as hydraulic actuators or cylinders, pumps, and solenoid valves (current-controlled variable pressure valves), in order to supply a desired amount of fluid pressure to various aspects of the loader 10. The angle sensor 24 of the disclosed embodiment may be an inclinometer that determines the angle "a" of the coupler relative to a ground reference. In some situations, other types of sensors for measuring the inclination of implement 25 may also be used such as by measuring the angle of coupler 22 relative to lift arm 21 or by measuring the amount of displacement of coupler 22 relative to a base position. Although the illustrated implement 25 is a bucket, the implement may be any other type of implement attachable to the coupler 22.

Figure 2:
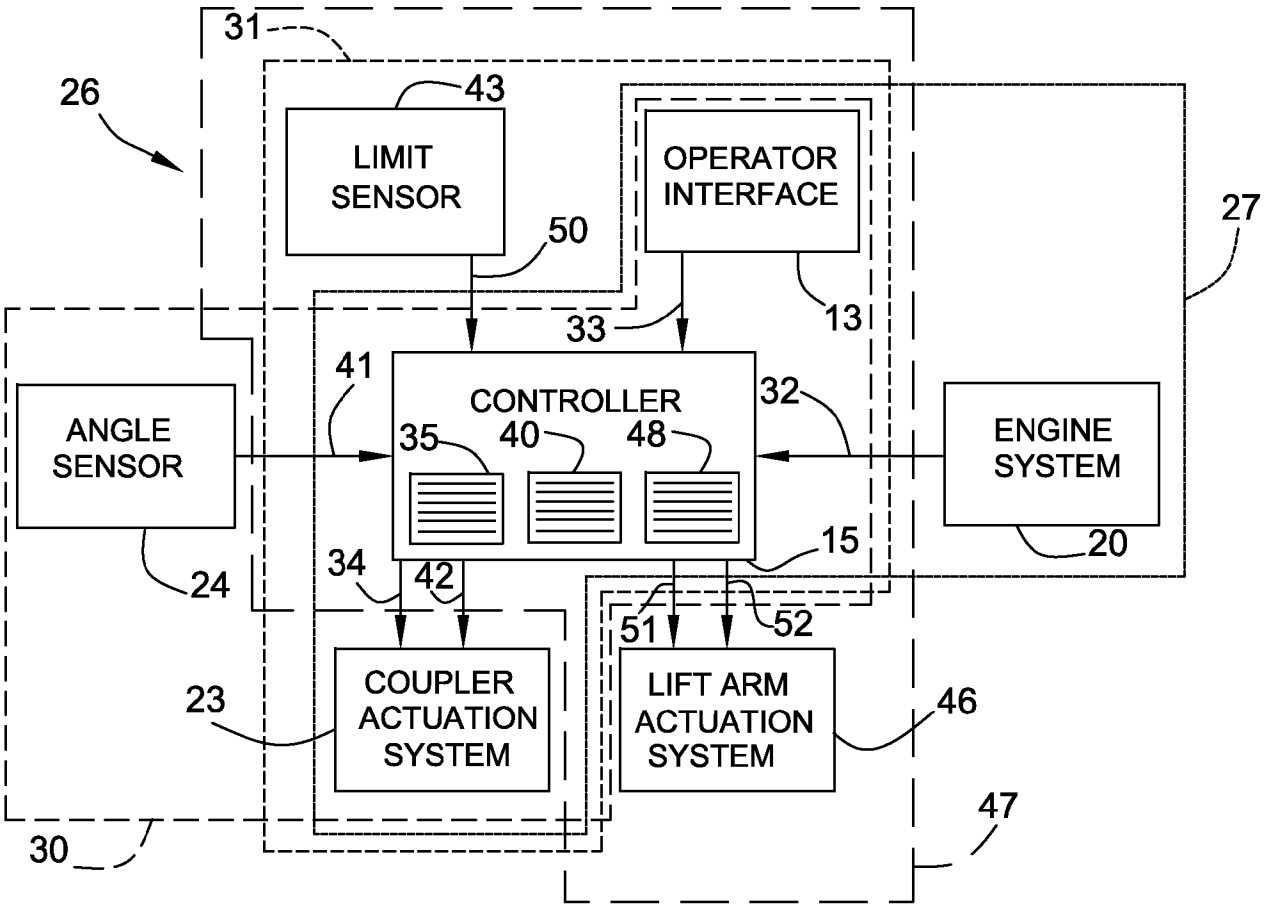
FIG. 2 is a schematic diagram of a system for use with the loader of FIG. 1.

Referring to FIG. 2, a system 26 of loader 10 is depicted for controlling movement of lift arm 21 and an angle of the implement 25. The system 26 includes an open loop subsystem 27, a closed loop subsystem 30, a limit subsystem 31, and a movement limiting subsystem 47. The open loop subsystem 27 includes the operator interface 13, the controller 15, the engine system 20, and the coupler actuation system 23. Specifically, in the open loop subsystem 27, the controller 15 is configured to receive a signal 32 indicative of the speed of the engine in the engine system 20 and a signal 33 indicative of an actuation of the operator interface 13. The operator interface actuation signal 33 is indicative of a command from an operator for the lift arm 21 to move at a speed associated with the degree of operator interface actuation. For instance, the operator interface 13 may be a joystick. In this example, the controller operates in a logical fashion to provide an output signal effecting a commanded lift arm movement speed that may vary directly with joystick displacement. Based at least upon the engine speed signal 32 and the operator interface actuation signal 33, the controller 15 calculates a first angle correction signal, also referred to herein as an open loop correction signal 34. The controller 15 then transmits the open loop correction signal 34 to the coupler actuation system 23 to move the coupler 22 which also results in the movement of the implement 25 attached to the coupler 22.

The controller 15 calculates the open loop correction signal 34 by multiplying an initial correction calculation by an engine speed factor. The initial correction calculation is associated with the commanded lift arm movement speed, whereas the engine speed factor is associated with the engine speed indicated by the engine speed signal 32. These associations may be specified in maps, lookup tables, or similar data structures that can be accessed by, or programmed into, the controller 15. Specifically, upon receiving the operator interface actuation signal 33 and discerning a commanded lift arm movement speed from the operator interface actuation signal 33, the controller 15 accesses a first map 35 that associates lift arm movement speeds with initial correction calculations and utilizes the first map 35 to determine the initial correction calculation associated with the lift arm movement speed indicated by the operator interface actuation signal 33. In addition, upon receiving the operator interface actuation signal 33, the controller 15 determines the engine speed indicated by the engine speed signal 32, accesses a second map 40 that associates engine speeds with engine speed factors, and utilizes the second map 40 to determine the engine speed factor associated with the engine speed indicated by the engine speed signal 32. Then, as mentioned above, the controller 15 multiplies the initial correction calculation by the engine speed factor to arrive at the open loop correction signal 34 to be transmitted to the coupler actuation system 23.

The closed loop subsystem 30 includes the operator interface 13, the controller 15, the coupler actuation system 23, and the angle sensor 24. Specifically, in the closed loop subsystem 30, the controller 15 receives a coupler angle signal 41 from the angle sensor 24 mounted on the coupler 22 and calculates a second angle correction signal, also referred to herein as a closed loop correction signal 42, based at least upon the coupler angle signal 41. More specifically, when the operator interface actuation signal 33 received by the controller 15 includes a command to start lift arm movement or to change the direction of lift arm movement from up to down or vice versa, the controller 15 stores the coupler angle most recently indicated by the coupler angle signal 41 as a target angle. The controller 15 then monitors the coupler angle signal 41 for deviations from the target angle. Next, the controller 15 calculates the difference between the stored target angle and the actual angle continually indicated by the coupler angle signal 41 and, based upon the calculated difference between the angles, transmits the closed loop correction signal 42 to the coupler actuation system 23 such that the coupler 22 is moved to the extent necessary for the actual angle indicated by the coupler angle signal 41 to match the target angle.

The limit subsystem 31 includes the operator interface 13, the controller 15, the coupler actuation system 23, a sensor such as a limit sensor 43 (FIG. 1), and upper and lower sensor triggers 44, 45. The sensor may be any type of presence or proximity sensor, while the upper and lower sensor triggers 44, 45 may be metal strips or any other elements configured to trigger the limit sensor 43. If desired, the sensor could be a mechanical switch triggered as it moves past trigger structures. The limit sensor 43 is mounted on the lift arm 21 of the loader 10 and the upper and lower sensor triggers 44, 45 are mounted on the loader 10 such that the limit sensor 43 detects the presence of the upper and lower sensor triggers 44, 45 as the lift arm approaches its upper and lower limits of the travel, respectively.

In one embodiment, the upper and lower sensor triggers 44, 45 may be positioned at a location approximately 10-12 inches less than the physical upper and lower limits of travel 55, 56 of lift arm 21. More specifically, referring to FIG. 1, lift arm 21 is depicted at its lower limit of travel 56. As depicted, limit sensor 43 is not aligned with the lower sensor trigger 45 when lift arm 21 is positioned at its lower limit of travel, but rather positioned slightly below or past the lower sensor trigger. This configuration permits the end of the lift arm 21 to continue to travel approximately 10-12 inches beyond the position where limit sensor 43 is aligned with and passes lower sensor trigger 45 at lower sensor trigger alignment position 58. Similarly, lift arm 21 may continue to travel approximately 10-12 inches beyond upper sensor trigger 44 after limit sensor 43 is aligned with and passes the upper sensor trigger at upper sensor trigger alignment position 57, until it reaches its upper limit of travel 55. The exact amount of travel (excluding reaching the upper and lower limits of travel) past the sensor triggers may be adjusted as desired by appropriately configuring the controller 15.

When the limit sensor 43 detects the presence of one of the upper and lower sensor triggers 44, 45, the limit sensor 43 is actuated or triggered and transmits a binary signal or limit signal 50 to the controller 15. The controller 15 is configured to receive the limit signal 50 and, upon receipt of the limit signal, to discontinue transmitting the open and closed loop correction signals 34, 42 to the coupler actuation system 23. Automatic movement of the coupler 22 by the system 26 is thus discontinued near the limits of travel of the lift arm 21, thereby helping to prevent overcorrection of the angle of the coupler 22, and by extension, overcorrection of the angle of the implement 25.

The controller 15 is also configured to calculate a position of the lift arm 21 based at least upon the limit signal 50. However, due to the simplified nature of the sensor system associated with the movement of lift arm 21 (i.e., limit sensor 43 positioned on lift arm 21 and upper and lower sensor triggers 44, 45 positioned on loader 10), controller 15 determines the position of the lift arm 21 in an indirect manner. In particular, the controller 15 determines the position of the lift arm 21 by referring to the operator interface actuation signal 33 to determine in which direction the operator interface actuation signal 33 most recently commanded the lift arm 21 to move. When the controller 15 receives a limit signal 50, if the operator interface actuation signal 33 indicates that the lift arm 21 was most recently commanded to move up, the controller 15 concludes that the limit sensor 43 has sensed the presence of the upper sensor trigger 44 and, by extension, that the lift arm 21 has reached a position near the upper limit of lift arm travel. Similarly, if the operator interface actuation signal indicates that the lift arm 21 was most recently commanded to move down, the controller 15 concludes that the limit sensor 43 has sensed the presence of the lower sensor trigger 45 and, by extension, that the lift arm 21 has reached a position near the lower limit of lift arm travel.

In other words, controller 15 is able to determine when lift arm 21 is near or above upper sensor trigger 44 and when it is near or below lower sensor trigger 45 but when the lift arm is positioned such that limit sensor 43 is between the upper and lower sensor triggers, controller 15 cannot determine the exact distance of the lift arm from either of the sensor triggers. In addition, once lift arm 21 passes upper sensor trigger 44 as the lift arm moves upward or the lower sensor trigger 45 as the lift arm moves downward, the exact distance of the lift arm past the sensor triggers is unknown. As such, the only time that controller 15 can identify the exact position of lift arm 21 is when the movement of the lift arm past either of the upper or lower sensor triggers 44, 45 results in triggering of the limit sensor 43.

The movement limiting subsystem 47 includes the operator interface 13, the controller 15, the engine system 20, the limit sensor 43, and the lift arm actuation system 46. System 26 includes a movement limiting mode in which the controller 15 operates to automatically control the speed of movement of the lift arm 21 as it approaches either of its upper or lower limits of travel 55, 56. More specifically, referring to FIG. 1, lift arm 21 is configured for arcuate movement along path 54 between an upper limit of travel 55 and a lower limit of travel 56. Each of the upper and lower limits of travel 55, 56 define physical end of travel positions of the lift arm 21. As stated above, end of the lift arm 21 may continue to move approximately 10-12 inches after limit sensor 43 is triggered by the upper or lower sensor triggers 44, 45. Movement limiting subsystem 47 utilizes the 10-12 inches of travel to automatically slow down the lift arm 21 in order to minimize the likelihood that the lift arm 21 will continue to move rapidly upwards after it passes the upper sensor trigger 44 at upper sensor trigger alignment position 57, or downward after it passes the lower sensor trigger 45 at lower sensor trigger alignment position 58. By automatically slowing down the lift arm 21 after it passes the upper and lower sensor triggers 44, 45, lift arm 21 is less likely to reach its upper and lower limits of travel 55, 56 while moving at a significant speed and thus reduce the likelihood of the lift arm being abruptly stopped. Such a sudden stop may cause wear to the machine, spillage of any material being carried by the implement and/or instability of the loader 10.

Movement of lift arm 21 past the upper and lower sensor triggers 44, 45 is controlled by a third data map 48 (FIG. 2) within controller 15 that determines the speed at which lift arm 21 moves. Since the speed of movement of the lift arm 21 is generally related to the engine speed, the engine speed is used to approximate the lift arm speed. In particular, controller 15 cannot determine the speed of lift arm 21 when limit sensor 43 is triggered by either of the upper or lower sensor triggers 44, 45 but uses the engine speed together with the third data map 48 to determine the command signals 51, 52 that are sent by the controller 15 to the lift arm actuation system 46. In one configuration, if the engine speed is relatively high (and thus the lift arm 21 is moving rapidly), the third data map 48 can be configured to significantly reduce the signal to the lift arm actuation system 46 and thus slow the lift arm 21 significantly. If the engine speed is lower, the data map may apply a smaller damping or snubbing factor so as to have less of an impact on the speed of the lift arm 21. Finally, if the engine speed is relatively slow, the third data map 48 may have no impact on the speed of the lift arm 21 and the movement of the lift arm will be directly proportional to the engine speed.

By way of example only, if the engine is operating at 100% of its maximum speed, after lift arm 21 passes one of the upper or lower sensor triggers 44, 45, the controller 15 may apply a damping or snubbing factor of 30% so that the map-based command signals 51 reduce the lift arm speed to 30% of its maximum rate. If the engine is operating at 60% of its maximum speed, the controller 15 may apply a damping or snubbing factor of 40% so that the map-based command signals 51 reduce the lift arm speed by 24% of its maximum rate. If the engine is operating at 20% of its maximum speed, the controller 15 may not apply a damping or snubbing factor at all so that the command signals generated are not reduced by the controller and the lift arm moves at 20% of its maximum rate.

Figure 3:
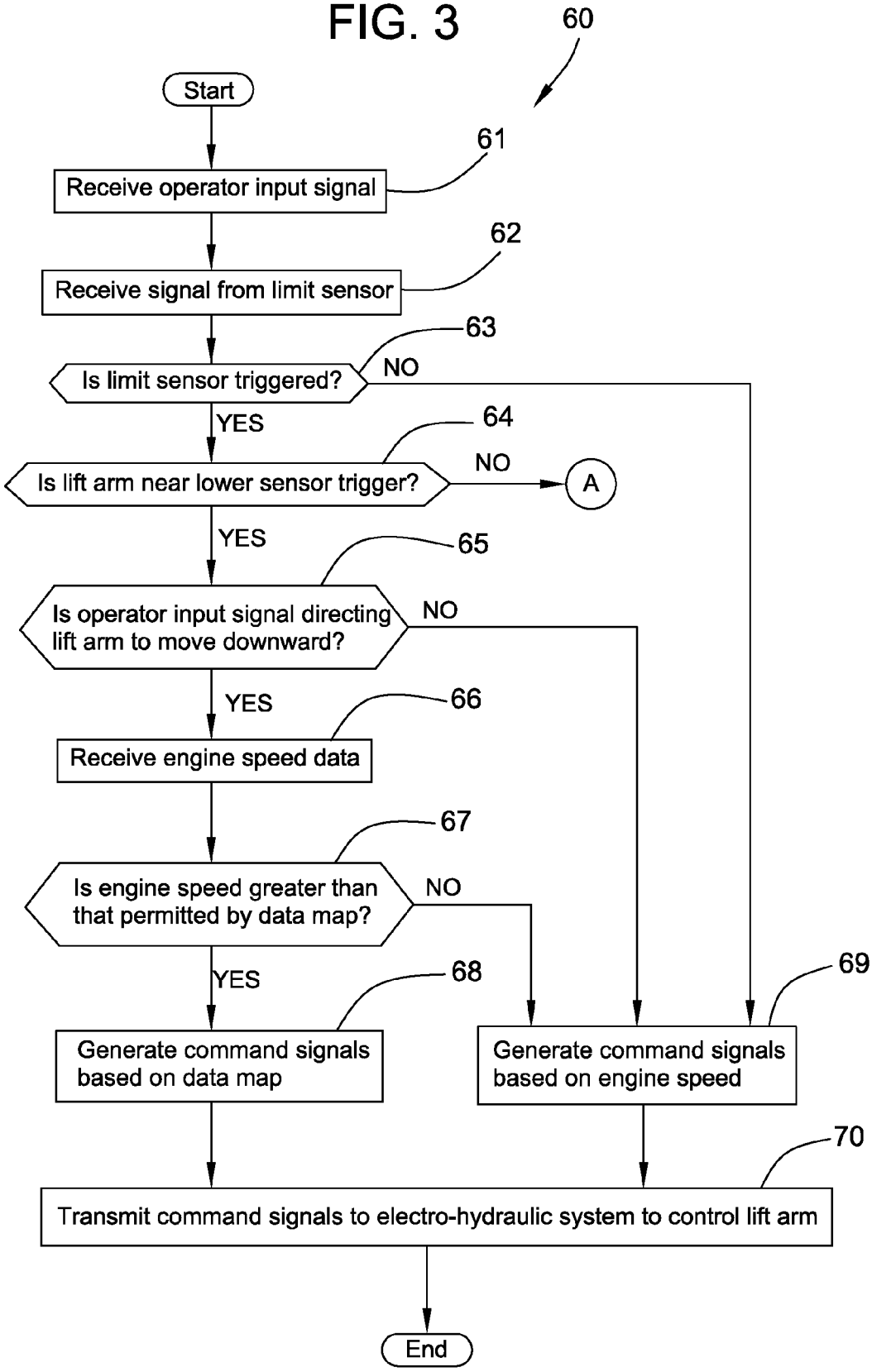
FIG. 3 is a flowchart illustrating a process for controlling a lift arm adjacent a lower limit of travel of the lift arm.
Figure 4:
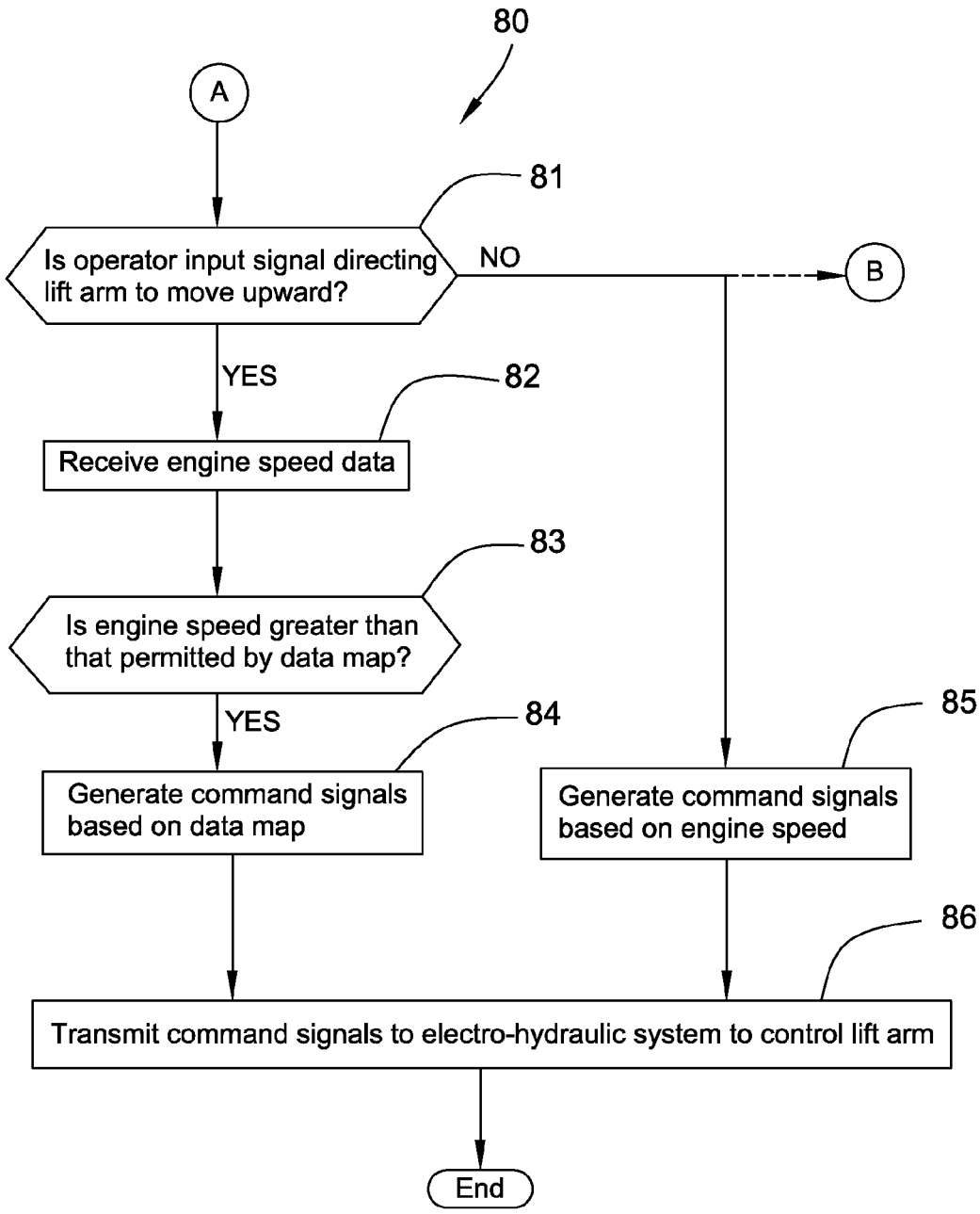
FIG. 4 is a flowchart illustrating a process for controlling the lift arm adjacent an upper limit of travel of the lift arm.
Figure 5:
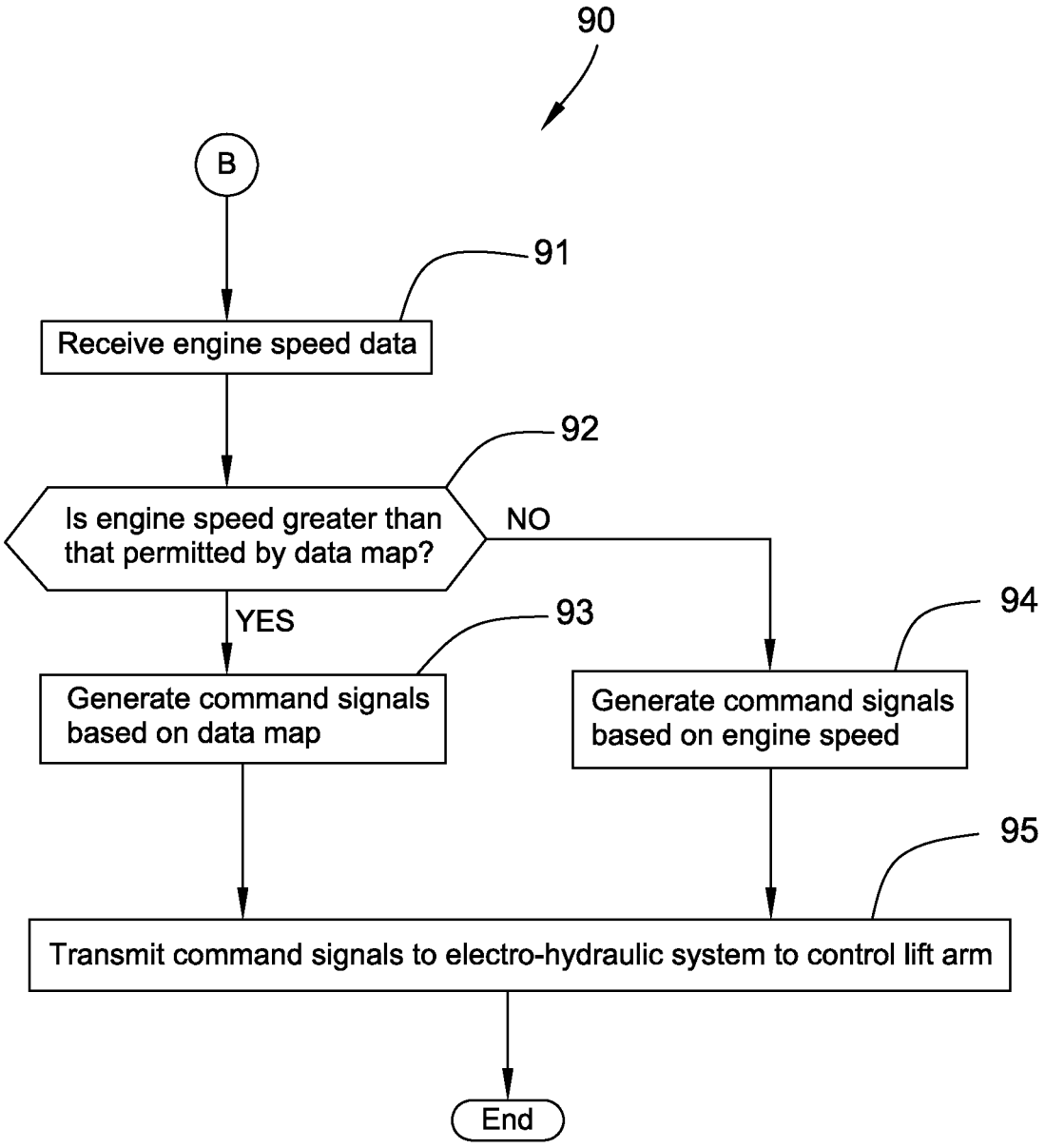
FIG. 5 is a flowchart illustrating an alternate process for controlling downward movement of the lift arm adjacent an upper limit of travel of the lift arm.

FIGS. 3-5 are flowcharts 60, 80, 90, depicting the movement limiting process. As an operator manipulates the operator interface 13 to perform any of the variety of tasks with lift arm 21 and implement 25, signals generated by the operator interface 13 are transmitted to and received by controller 15 at stage 61. Controller 15 is connected to limit sensor 43 in order to receive signals from the limit sensor at stage 62, so that upon limit sensor 43 passing one of the upper and lower sensor triggers 44, 45, controller 15 receives a signal from limit sensor 43 indicative of a change in status of the limit sensor. If the limit sensor has not been triggered at stage 63, (meaning that lift arm 21 is positioned in the central range 59 (FIG. 1) of motion of lift arm 21 between the upper sensor trigger alignment position 57 at which limit sensor 43 is aligned with upper sensor trigger 44 and the lower sensor trigger alignment position 58 at which the limit sensor 43 is aligned with lower sensor trigger 45), movement limiting subsystem 47 does not have an affect on the signals generated by the operator interface 13 and thus the engine speed-based command signals 52 generated by controller 15 are based upon or directly proportional to the engine speed at stage 69.

If, however, the limit sensor 43 has been triggered at stage 63, the operation of controller 15 and lift arm actuation system 46 are dependant upon the position of lift arm 21. If the lift arm 21 is near the lower sensor trigger 45 and thus stage 64 is satisfied, the controller 15 analyzes the operator input signal received at stage 61 in order to determine whether the operator is directing the lift arm 21 to move upward or downward. If the operator is not directing the lift arm 21 to move downward (and thus stage 65 is not satisfied), movement limiting subsystem 47 does not have an affect on the signals generated by the operator interface 13 and the engine speed-based command signals 52 generated by controller 15 are based upon the engine speed at stage 69.

If the operator is directing lift arm 21 downward and thus satisfies stage 65, controller 15 receives engine speed signal 32 at stage 66. The engine speed signal 32 is compared to the third data map 48 at stage 67 and if the engine speed is less than that permitted by the data map, controller 15 does not affect the desired operator input and the engine speed-based command signals 52 generated by controller 15 are based upon the engine speed at stage 69. If the engine speed is greater than that permitted by the third data map 48, controller 15 will utilize a damping or snubbing factor within the data map to generate map-based command signals 51 at stage 68 that are damped relative to the engine speed. In each instance, the command signals 51, 52 generated by controller 15 at stage 68 or stage 69 are transmitted to the electro-hydraulic lift arm actuation system 46 in order to control lift arm 21 at stage 70.

If the limit sensor 43 has been triggered and the lift arm 21 is not positioned such that sensor 43 is aligned with or below lower sensor trigger 45 (and thus does not satisfy stage 64), lift arm 21 is located at the upper sensor trigger alignment position 57, at the upper limit of travel 55 or somewhere between those two positions. In such a case, referring to flowchart 80 in FIG. 4, controller 15 determines at stage 81 whether the signal 33 received by controller 15 from the operator interface 13 is directing the lift arm 21 upward or downward. If the operator is not directing the lift arm 21 upward, and thus stage 81 is not satisfied, controller 15 does not affect the desired operator input and the engine speed-based command signals 52 generated by controller 15 are based upon the engine speed at stage 85. If the operator is directing lift arm 21 upward, and thus satisfies stage 81, controller 15 receives engine speed signal 32 at stage 82. The engine speed signal 32 is compared to the third data map 48 at stage 83 and if the engine speed is less than that permitted by the data map, controller 15 does not affect the desired operator input and thus the engine speed-based command signals 52 generated by controller 15 are based upon the engine speed at stage 85. If the engine speed is greater than that permitted by the third data map 48, controller 15 will utilize a damping or snubbing factor within the data map to generate map-based command signals 51 at stage 84 that are damped relative to the engine speed. In each instance, the command signals 51, 52 generated by controller 15 at stage 84 or stage 85 are transmitted to the electro-hydraulic lift arm actuation system 46 in order to control lift arm 21 at stage 86.

In an alternative design, the movement limiting subsystem 47 may include an additional feature to increase the stability of loader 10 when lift arm 21 is positioned at its upper limit of travel 55. If the operator interface actuation signal 33 is directing lift arm 21 downward and thus the condition at stage 81 is not met, rather than following stage 85 and generating engine speed-based command signals 52 based on the engine speed, controller 15 may be configured to follow flowchart 90 in FIG. 5 to automatically limit or snub the initial downward movement of lift arm 21. In some circumstances, this functionality may be desirable in order to increase the stability of the loader 10. With such an operation, controller 15 receives engine speed signal 32 at stage 91. The engine speed signal 32 is compared to the third data map 48 at stage 92 and if the engine speed is less than that permitted by the data map, controller 15 does not affect the desired operator input and the engine speed-based command signals 52 generated by controller 15 are based upon the engine speed at stage 94. If the engine speed is greater than that permitted by the third data map 48, controller 15 has a damping factor or factors within the data map to generate map-based command signals 51 at stage 93 that are damped relative to the engine speed. The damping factor or factors may be configured such that the command signals increase linearly or non-linearly and eventually become directly proportional to the desired engine speed in order to minimize rapid downward acceleration of the lift arm 21. In each instance, the command signals 51, 52 generated by controller 15 at stage 93 or stage 94 are transmitted to the electro-hydraulic lift arm actuation system 46 in order to control lift arm 21 at stage 95.

INDUSTRIAL APPLICABILITY

The industrial applicability of the system described herein will be readily appreciated from the foregoing discussion. The present disclosure is applicable to many machines and many tasks accomplished by machines. One exemplary machine for which the system is suited is a wheeled loader. However, the system may be applicable to any type of loader and any type of machine that would benefit from automated control of a lift arm near its limits of travel.

The disclosed system may modify or damp the input from an operator of a machine when a lift arm is approaching a limit of travel of the lift arm in order to slow down movement of the lift arm. If the lift arm is a spaced from the end of travel position a distance greater than a predetermined amount or if the lift arm is moving more slowly than a predetermined rate, the lift arm is controlled by commands from the operator rather than by commands modified by the system. It is generally desirable to avoid rapidly stopping the movement of the lift arm as it reaches its upper and lower limits of travel, since such a sudden stop may cause wear to the machine, spillage of any material being carried by the implement and/or instability of the machine. The system may also modify movement of the lift arm upon initial movement of the lift arm from an upper limit of travel towards a lower limit of travel.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A system for automatically controlling movement of a lift arm of a loader near a limit of travel of the lift arm, the system comprising:

a sensor on one of the lift arm and the loader;

a sensor trigger on another of the lift arm and the loader; and a controller configured to:

receive an engine speed signal indicative of an engine speed of an engine on the loader;

receive an operator interface actuation signal indicative of an actuation of an operator interface on the loader, the operator interface actuation signal indicating a desired movement of the lift arm;

receive a sensor actuation signal indicative of actuation of the sensor based upon movement of the sensor near the sensor trigger at a position near the limit of travel of the lift arm;

determine a lift arm command signal for directing movement of the lift arm based at least upon the engine speed signal and receipt of the sensor actuation signal; and transmit the lift arm command signal to an electro-hydraulic system to control the movement of the lift arm.

2. The system of claim 1, wherein the controller is further configured to determine the position of the lift arm, and the lift arm command signal is determined based in part upon the position of the lift arm.

3. The system of claim 1, wherein the controller is further configured such that the lift arm command signal is determined based in part upon the operator interface actuation signal.

4. The system of claim 3, wherein the operator interface actuation signal indicates a desired direction of movement of the lift arm.

5. The system of claim 1, wherein the controller is further configured such that the movement directed by the lift arm command signal is directly proportional to the engine speed signal upon deactuation of the sensor on the lift arm.

6. The system of claim 1, wherein the controller is further configured such that the lift arm command signal is determined in part by comparing a desired speed of movement of the lift arm based upon the engine speed signal to a data map speed of movement based upon the engine speed signal, and the lift arm command signal is based in part upon whichever movement is slower as between the desired speed of movement and the data map speed of movement.

7. The system of claim 1, further including first and second sensor triggers spaced apart and mounted on the loader, the first sensor trigger being adjacent an upper limit of travel of the lift arm and the second sensor trigger being adjacent a lower limit of travel of the lift arm.

8. A loader, comprising:

an engine system including an engine;

an operator interface;

a lift arm;

a sensor mounted on one of the loader and the lift arm;

at least one sensor trigger for actuating the sensor when the lift arm is near a limit of travel of the lift arm, the sensor trigger being mounted on another of the loader and the lift arm; and a controller configured to:

receive an engine speed signal indicative of engine speed of an engine on the loader;

receive an operator interface actuation signal indicative of actuation of the operator interface, the operator interface actuation signal indicating a desired movement of the lift arm;

receive a sensor actuation signal indicative of actuation of the sensor upon movement of the sensor near the sensor trigger;

determine a lift arm command signal for directing movement of the lift arm based at least upon the engine speed signal and receipt of the sensor actuation signal; and transmit the lift arm command signal to an electro-hydraulic system to control the movement of the lift arm near the limit of travel of the lift arm.

9. The loader of claim 8, wherein the controller is further configured to determine the position of the lift arm, and the lift arm command signal is determined based in part upon the position of the lift arm.

10. The loader of claim 8, wherein the controller is further configured such that the lift arm command signal is determined based in part upon the operator interface actuation signal.

11. The loader of claim 10, wherein the operator interface actuation signal includes a desired direction of movement of the lift arm.

12. The loader of claim 8, wherein the controller is further configured such that the movement directed by the lift arm command signal is directly proportional to the engine speed signal upon deactuation of the sensor on the lift arm.

13. The loader of claim 8, wherein the sensor is a limit switch providing binary signals to the controller.

14. The loader of claim 8, further including first and second sensor triggers spaced apart and mounted on the loader, the first sensor trigger being adjacent an upper limit of travel of the lift arm and the second sensor trigger being adjacent a lower limit of travel of the lift arm.

15. The loader of claim 8, wherein the loader includes a pair of spaced apart lift arms, an implement and a coupler configured to couple the implement to the lift arms.

16. A controller-implemented method for controlling movement of a lift arm of a loader near a limit of travel of the lift arm, the method comprising:

receiving an engine speed signal at a controller indicative of engine speed of an engine on the loader;

receiving an operator interface actuation signal at the controller indicative of actuation of an operator interface on the loader, the operator interface actuation signal indicating a desired movement of a lift arm on the loader;

receiving a sensor actuation signal at the controller indicative of actuation of a sensor on one of the lift arm and the loader based upon movement of the sensor near a sensor trigger on the loader at a position near a limit of travel of the lift arm;

automatically determining a lift arm command signal for directing movement of the lift arm based at least upon the engine speed signal and receipt of the sensor actuation signal; and transmitting the lift arm command signal from the controller to an electro-hydraulic system to control movement of the lift arm near the limit of travel of the lift arm.

17. The method of claim 16, further including the step of automatically determining a position of the lift arm, and the step of automatically determining the lift arm command signal is based in part upon the position of the lift arm.

18. The method of claim 16, wherein the step of determining the lift arm command signal is based in part upon the operator interface actuation signal.

19. The method of claim 16, wherein the step of automatically determining the lift arm command signal includes comparing a desired speed of movement of the lift arm based upon the engine speed signal to a data map speed of movement based upon the engine speed signal and the lift arm command signal is in part based upon whichever movement is slower as between the desired speed of movement and the data map speed of movement.

20. The method of claim 16, further including transmitting an operator interface actuation signal from the controller to the electro-hydraulic system that is directly proportional to the engine speed signal upon receiving a signal at the controller indicative of deactuation of the sensor on the lift arm.

* * * * *